United States Patent [19]

Guidevaux

[11] Patent Number: 4,551,693

[45] Date of Patent: Nov. 5, 1985

[54] COAXIAL MICROWAVE LOAD ISOLATOR OF THE THREE-PLATE TYPE INCLUDING SUCH A LOAD AND USE OF SUCH AN ISOLATOR

[75] Inventor: Jacques Guidevaux, Chatillon sous Bagneux, France

[73] Assignee: Thomson CSF, Paris, France

[21] Appl. No.: 552,105

[22] Filed: Nov. 16, 1983

[30] Foreign Application Priority Data

Nov. 19, 1982 [FR] France ..... 82 19429

[51] Int. Cl.[4] ..... H01P 1/26; H01P 1/36

[52] U.S. Cl. ..... 333/22 R; 333/24.2

[58] Field of Search ..... 333/22 R, 81 A, 24.2; 338/216

[56] References Cited

U.S. PATENT DOCUMENTS 2,839,730 9/1954 Rosenberg, Jr. .
3,324,424 2/1965 Barker .
3,492,604 1/1970 Fan .
3,935,549 1/1976 Jachowski .

FOREIGN PATENT DOCUMENTS 2445038 7/1980 France .

OTHER PUBLICATIONS

Bell Laboratories Record, vol. 49, No. 1, Jan. 1971, pp. 27–31, Murray Hill (USA), A. Hamori et al.: "Advances in Radio Relay Design: The TH—3 Microwave Radio System", p. 30.

IEEE Spectrum, vol. 7, No. 7, Jul. 1970, p. 10, New York (USA); "Miniature Crossroads for Microwaves".

IBM Technical Disclosure Bulletin, vol. 12, No. 7, Dec. 1969, pp. 993–994, New York (USA); R. Abbatecola et al.: "High-Performance Biasable Coaxial Termination".

*Primary Examiner*—Paul Gensler

*Attorney, Agent, or Firm*—Cushman, Darby & Cushman

[57] ABSTRACT

A coaxial microwave load for a ferrite isolator formed by a three-plate three-port type junction circulator comprising an assembly including by a body of conductive material, a rod of insulating material which is covered with a layer of resistive material, and a washer of insulating material. The assembly is placed in a mounting block of conductive material having an axial bore to receive the assembly and the mounting block is covered with a layer of insulating material whereby the load is electrically insulated.

13 Claims, 4 Drawing Figures

COAXIAL MICROWAVE LOAD ISOLATOR OF THE THREE-PLATE TYPE INCLUDING SUCH A LOAD AND USE OF SUCH AN ISOLATOR

The present invention relates to ferrite devices, and in particular to isolators individually made from one or more series-connected circulators of the three-plate, three-port, Y-junction type, and relates more particularly to a coaxial microwave load connected to one of the circulator ports.

BACKGROUND OF THE INVENTION

A circulator structure of the three-plate, three-port Y-junction type is known and described in U.S. Pat. No. 3,935,549, wherein the junction circulator mainly comprises a central conductor having three branches which is inserted between two disks of ferrimagnetic or gyromagnetic material, and two ground planes disposed on respective sides of the two disks.

Generally speaking, it is known that an isolator is constituted by one or more series-connected circulators of the three-port, three-plate type, as described above, having one of the ports terminated by a matching 50 ohm microwave load placed between the central conductor and ground. A known coaxial microwave load structure comprises a conductive tube housing both a rod of insulating material covered with a layer of resistive material matched to 50 ohm and provided at its ends with two metallized portions one of which is connected to a load body, and an insulating washer placed between the rod and the body. When the load is connected to one of the ports of the circulator, the body is fixed to the ground planes while the other metallized portion of the rod is fixed to the central conductor. The isolator thus obtained is finished by mounting a connector to each of its other two ports.

Further, one of the known uses of an isolator made, for example, from a single circulator of the three-port, three-plate type and having one port closed by a coaxial load, is derived from fact that such an isolator serves as a decoupling means between a microwave source and a microwave circuit such as a mixer or an amplifier for example, which circuit generally includes active devices that need biasing from a DC source, such as transistors and diodes, for example. In this aplication, the microwave source is connected to a first port of the circulator known as the input port, the acitve device needing biasing is connected to a second port of the circulator known as the output or user port, the coaxial load of the type described above is connected between ground and the third port of the circulator, and the bias source is connected between ground and the active device. However, in such an arrangement, the 50 ohm coaxial load is electrically connected across the terminals of the bias source for the active device, thereby causing the device to be incorrectly biased, and thus preventing it from operating in satisfactory manner. Consequently, it is necessary to provide DC isolation between the load and ground.

Various techniques are already known for providing DC isolation of a coaxial load connected to one of the ports of a three-port, three-plate type circulator in order to decouple a microwave source from an active device requiring a DC bias. One of these techniques consists in placing an intermediate mechanical part between the so-called user port of the circulator and the active component, said part being constituted by a first conductive tube housing an insulant and a central conductive tape having a cross cut and thus constituting a capacitance across whose terminals there are connected the active device and the so-called user port of th circulator, whereby the coaxial load is DC isolated by the presence of the capacitance. Further, said intermediate mechanical part includes, downstream from the capacitance, a second conductive tube connected in parallel with the first tube and having the bias source of the active device connected across its terminals, whereby said second tube constitues the DC input for biasing the active component. However, this T-shaped intermediate component constitutes a supplementary component to be arranged between the isolator and the acitve device, and thus constitutes extra bulk which provides losses. Further, this component is relatively expensive and has low performance characteristics, especially at high frequencies.

One aim of the present invention is to provide a ferrite isolator in particular for decoupling a microwave source from an active device that needs to be biased. The isolator is made from one or more series-connected circulators of the three-port three-plate type each of which includes a port connected to a matched 50 ohmn load which, by virtue of its structure, simultaneously constitutes a DC isolated load and a bias current input for the active device, thereby avoiding the use of a prior art T-shaped part. The coaxial load in accordance with the invention is of simple structure based on components which are conventional, provide good performance, are reliable and cheap, and are entirely satisfactory at all usual high frequencies for coaxial line transmission, with a maximum frequency of about 18 GHz.

SUMMARY OF THE INVENTION

The present invention provides a coaxial microwave load comprising:

a first assembly including a cylindrical conductive body, a cylindrical rod lodged inside the body and made of insulating material which is covered with a resistive layer, and which has two metallized ends, and a first washer of insulating material interposed between the body and the rod, said first assembly constituting a first coaxial transmission line having a given characteristic impedance to which the resistive layer of the rod is matched; and a mounting block made of conductive material and having a central bore for receiving said first assembly, the surface of said mounting block being covered with an insulating layer, whereby said load is DC isolated once said first assembly is lodged in said mounting block.

According to an additional feature of the present invention, the load further includes a connector disposed in a longitudinal prolongation of the mounting block, said connector being provided with a base which is fixed to said mounting block, and having a central conductor ribbon with one end connected to said body of the first assembly and with its other end connected to a DC voltage source, said connector, once fixed to said mounting block, constituting an inlet terminal for said DC voltage source.

The invention also provides an isolator made from one Y-junction circulator of the three-plate type having one of its ports terminated by a load in accordance with the invention, and used to decouple a microwave source from an active device that requires biasing.

BRIEF DESCRIPTION OF THE DRAWINGS

An embodiment of the invention is described by way of example with reference to the accompanying drawings, in which.

In the different figures, the same reference numerals are used to designate the same elements.

DETAILED DESCRIPTION OF THE PREFERRED EMBODIMENT

Figure 1:
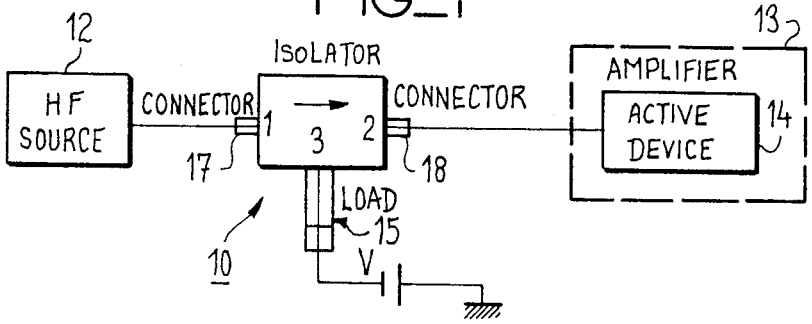
FIG. 1 is a block diagram of an isolator made from a single circulator having one port terminated by a load in accordance with the invention, and being used as a decoupling circuit between a microwave source and an active component that requires biasing.

FIG. 1 shows one embodiment of the invention in which a ferrite isolator 10 is used as decoupling means between a microwave source 12 and a microwave circuit which is constituted, for example, by an amplifier 13 which includes an active device 14, such as a transistor, which requires DC biasing.

The isolator 10 is made, for example, from a single Y-junction three-plate type circulator having three ports or channels referenced 1, 2 and 3 respectively, with port 3 terminated by a coaxial load 15 matched to 50 ohms.

In accordance with an aspect of the invention, the coaxial load 15 is DC isolated by virtue of its structure which is described below with reference to FIG. 4, and is directly connected to a DC voltage source V for biasing the active device 14.

The isolator 10 further includes a first connector 17 mounted on its input port 1 and connected to the microwave source 12, and a second connnector 18 mounted on its output or utilization port 2 and connected to the active device 14.

In this utilization, the use of such an isolator is justified as follows:

Firstly, in the absence of an isolator, the microwave energy emitted by the source 12 is reflected on the active device 14, and this reflected energy is then received by the source 12 which is disturbed thereby.

In the presence of an isolator, and after the emitted energy has been passed from port 1 to port 2, the energy which is reflected by the active device 14 is subsequently transmitted from port 2 to port 3 where it encounters the grounded load 15, thereby preventing any of the reflected energy reaching the source 12, and thus leaving it undisturbed.

Figure 2:
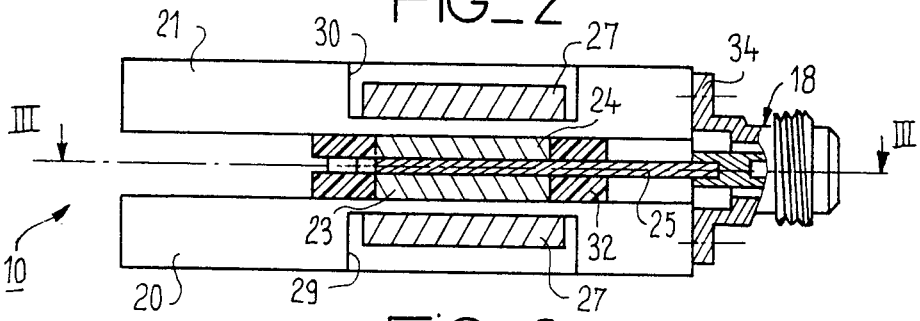
FIG. 2 is a section through a three-plate type Y-junction circulator used as an isolator, ie. having one of its ports terminated by a load in accordance with the invention.
Figure 3:
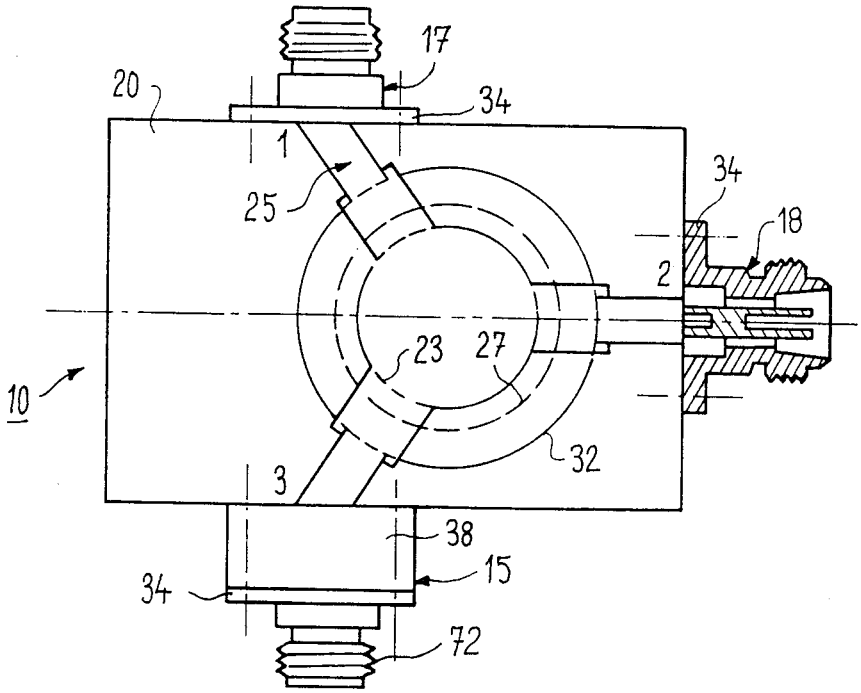
FIG. 3 is a section along a line III—III of FIG. 2.

FIGS. 2 and 3 are two sections through an isolator 10 which is made of a single Y-junction circulator of the three-plate type.

The isolator comprises two ground planes 20 and 21 disposed on respective sides of two disks 23 and 24 which are made of ferrimagnetic or of gyromagnetic material constituted by a ferrite suitable for use at high frequencies.

The isolator 10 further includes a central conductor 25 which is inserted between the two ferrite disks 23 and 24, and which is constituted by three branches at 120° to one another. The isolator also includes means for applying a magnetic bias field to the two ferrite disks 23 and 24, said means being constituted, for example, by a permanent magnet in the form of disks 27 which are housed in cavities 29 and 30 provided in the ground planes 20 and 21 respectively.

Rings of dielectric material 32 are inserted each between each plane and the central conductor, 25 these rings surround the ferrite disks 23 and 24.

As can be seen in FIG. 3, two of the branches of the conductor 25 are intended to constitute isolator ports 1 and 2. These two branches are fixed, eg. by soldering, to two identical conventional connectors 17 and 18, with only the connector 18 being shown in the section. Each of the two connectors 17 and 18 comprises a base 34, eg. of square section, fixed to the ground planes 20 and 21 by means of screws (not shown). The third branch of the conductor 25, constituting port 3, is fixed eg. by soldering, to the coaxial load 15 which is matched to 50 ohms. This load is described with reference to FIG. 4.

In a preferred embodiment of the invention, the 50 ohm coaxial load 15 comprises a mounting block 38 of parallelipipedic shape, eg. having a square section, and intended to be fixed to the two ground planes 20 and 21 of the isolator. The mounting block 38 is pierced along its longitudinal axis by a central bore 39 intended to receive over its entire length three sets of mechanical parts which together form a coaxial transmission line having a characteristic impedance of 50 ohms.

The mounting block 38 is made of conductive material such as aluminum for example, and is covered over its entire surface, both inside and outside, with a thin insulating layer 40 such as alumina, for example, which may by obtained by anodic oxidation in a bath of sulfur.

The first load assembly with an overall reference 42 comprises firstly a conductive cylindrical body 44, eg. made of aluminum, of given length and having a U-shaped longitudinal section. Inside the body 44 there is a rod or plug 45 of insulating material, such as alumina for example, with a resistive layer, eg. of tantalum nitride, deposited thereon and having metallization 46 at each end. The rod 45 is shorter than the body 44, and one of the metallizations 46 is fixed, eg. by soldering, to the conductive end face of the body 44.

Between the body 44 and the rod 45 there is a washer 48 made of insulating material such as Teflon (registered trade mark) for example which extends substantially over the entire length of the body 44. The asesmbly of body 44, rod 45 and washer 48 thus constituted forms a first coaxial transmission line having a characteristic impedance of 50 ohms to which the resistive layer of the rod 45 is matched.

This first load assembly 42 further includes an intermediate part in the form of a rod 49 made of conductive material such as gold-plated beryllium bronze for example, and extending in the longitudinal prolongation of the rod 45 to project from the other end face of the body 44 which face is open. One end of the part 49 is fixed, eg. by soldering, to the other metallization 46 of the rod 45, while the other end of the part 49 is provided with an axial blind hole 50. The assembly of the body 44, the part 49 and the washer 48 thus constituted forms a second coaxial transmission line which is continuous with the first coaxial line described above.

A second load assembly with an overall reference 52 comprises a washer 54 made of insulating material such as Teflon (registered trade mark) for example and having a diameter which is substantially less than the diameter of the body 44. The washer 54 has a central bore in which a rod 55 of conductive material such as gold-plated beryllium bronze is fixed. The rod 55 has a pointed end 56 which projects longitudinally from the washer.

The first and second assemblies 42 and 52 are fitted together by inserting the point 56 of the rod 55 into the blind hole 50 of the part 49, the rod 55 thus constituting a contactor. When the insertion has been performed, the washer 54 comes into contact with the washer 48.

Once the two assemblies 42 and 52 have been joined together, they are inserted into the axial bore of the mounting block 38 in such a manner that the body 44 abuts against an annular shoulder 61 made in said bore. The washer 54 and the contactor 55 come level with the "front" open face of the mounting block 38, ie. the face which is fixed on the two ground planes 20 and 21 of the isolator. To provide electrical continuity between the central conductor 25 and the fitted assemblies 42 and 52, the contactor 55 is fixed, eg. by soldering, to the central conductor 25. Thus the assembly comprising the mounting block 38, the contactor 55, and the washer 54 forms a third coaxial transmission line which is continuous with the second coaxial transmission line described above.

After both the first and second assemblies 42 and 52 have been inserted in the mounting block 38, and the contactor 55 and the mounting block 38 have been respectively connected to the central conductor 25 and the two ground planes 20 and 21, the assembly 42 is electrically isolated from ground by the presence of the insulating layer 40 which constitutes an electrical barrier both between the body 44 and the mounting block 38 and between mounting block 38 and the ground planes 20 and 21.

A third load assembly, with an overall reference 62 comprises a washer 64 of insulating material such as Teflon (registered trade mark) for example, having a central conductor 66 made of silver impregnated silicone rubber for example passing therethrough. The assembly 62 is received in the bore of the mounting block 38 and bears against the body 44 at the level of an annular shoulder 67 provided in the bore. Once it has been lodged in the mounting block 38, the assembly 62 comes level with the opposite or "rear" end face of the mounting block 38, and the assembly thus constituted by the conductor 66, the mounting block 38 and the washer 64 forms a fourth coaxial tansmisison line which is continuous with the above-mentioned first coaxial line.

Figure 4:
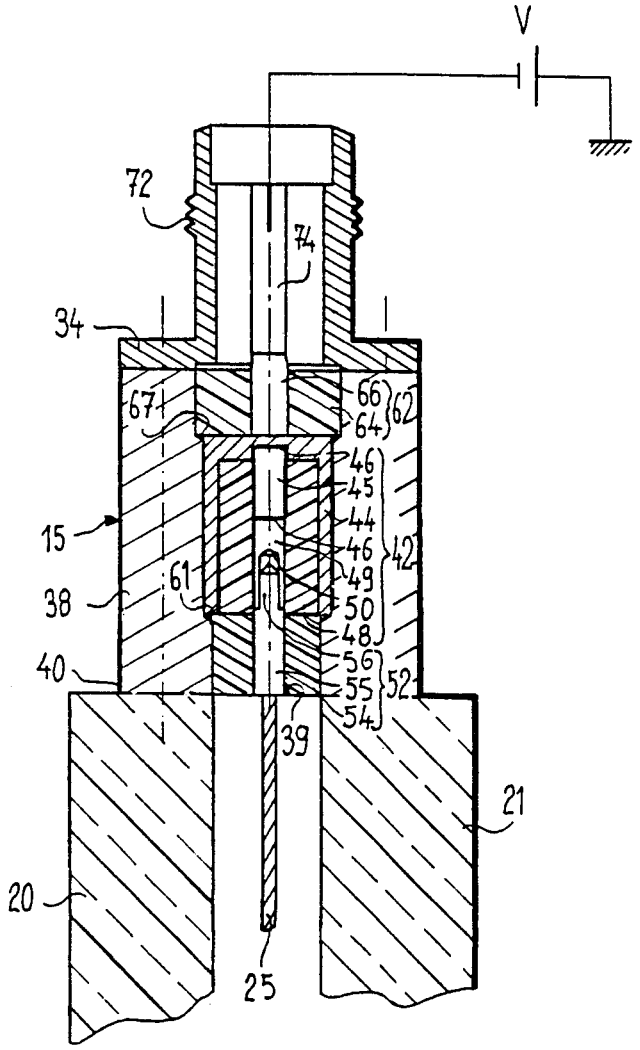
FIG. 4 is a longitudinal section through an assembly comprising a portion of an isolator and a load in accordance with the invention.

As can be seen in FIG. 4, the load 15 further includes a conventional connector 72 which is identical to the connectors 17 and 18 in FIG. 3 and which is located in the longitudinal prolongation of the mounting block 38. The connector 72 comprises a base 34 whose section is identical to that of the mounting block 38, eg. square, and is fixed to the mounting block 38 by means of screws (not shown) which also serve to fix the mounting block on the ground planes 20 and 21.

The connector 72 further includes a central conductor ribbon 74 surroounded by a dielectric and mounted at one of its ends in contact, eg. by pressure, with the conductor 66 of the assembly 62. The other end of the ribbon 74 is provided with a pin for connection to one of the terminals of a DC source V, whose other terminal is grounded.

It will be noted that the conductive portions of the three assemblies 42, 52 and 62 provide electrical continuity between the connector and the central conductor of the isolator.

Thus, the above-described load has a structure which enables it to be used simultaneously as a DC isolated load and as a bias input for an active device.

The above description has been made with reference to an isolator comprising a single Y-junction circulator which has one of its ports terminated by a matched load. The invention is also applicable to an isolator made up from two or more Y-junction circulators connected in series, with each circulator having one of its ports terminated by a matched load, thereby obtaining greater isolation.

What is claimed is:

1. A coaxial microwave load comprising:

a first assembly including a cylindrical conductive body, a first cylindrical rod lodged inside said body, made of insulating material and covered with a resistive layer, said first rod having first and second metallized ends, and a first washer of insulating material interposed between said body and said first rod, said first assembly constituting a first coaxial transmission line having a given characteristic impedance to which said resistive layer of said first rod is mateched; and a mounting block made of conductive material and having a central bore for receiving said first assembly, said mounting block having an inside surface and an outside surface both of which are covered with an insulating layer, whereby said load is DC isolated once said first assembly is lodged in said mounting block.

2. A load according to claim 1, wherein said conductive material of said mounting block is aluminum and said insulating layer deposited on said mounting block is alumina.

3. A load according to claim 1 wherein said cylindrical body includes first and second end faces, said first end face is closed by a conductive portion to which said first metallized end of said first rod is fixed, and wherein said second end face of said cylindrical body is open to enable said first rod and said first washer to be inserted into said body, wherein said first rod is shorter than said body, and wherein said first washer is of substantially the same length as said body.

4. A load according to claim 3, wherein said first assembly further includes an intermediate conductive member provided with a central hole and lodged inside said body between said second end face of said body and said second metallized end of said first rod to which said intermediate member is fixed, said intermediate conductive member and said first washer forming a second coaxial transmission line which is continuous with said first coaxial transmission line; and wherein said load further includes a second assembly including:

a second washer of insulating material which has a diameter that is substantially less than said diameter of said body, and which has a central bore; and a second rod made of conductive material fixed in said second washer central bore and having one end which terminates in a longitudinally projecting point for making contact with said intermediate member inside said intermediate member central hole, said second washer abutting against said first washer whereby said first and second assemblies comprise a single unitary assembly once said point has made contact inside said central hole.

5. A load according to claim 4, wherein said mounting block is in the shape of a parallelipiped having a longitudinal axis with said mounting block central bore extending therealong, said mounting block central bore opening out in first and second opposite faces of said block and receiving said first and second assemblies once they are assembled to each other, and wherein said mounting block central bore has a first annular shoulder against which said second end face of said cylindrical body of said first assembly abuts, said second washer of said second assembly being flush with said second opposite face of said block, whereby an assembly comprising said block, said second rod and said second washer forms a third coaxial transmission line which is continuous with said second coaxial transmission line.

6. A load according to claim 5, further including a third assembly including a third washer of insulating material and having a central orifice, and a third rod made of conductive material and fixed in said orifice, said third assembly being mounted in said mounting block, and wherein said mounting block central bore includes a second annular shoulder flush with said first end face of said cylindrical body of said first assembly when said first assembly is lodged in said mounting block central bore, one end of said third washer abutting against said second annular shoulder when said third washer is inserted into said mounting block central bore, and the other end of said third washer being flush with said first opposite face of said mounting block, whereby an assembly comprising said mounting block, said third rod and said third washer forms a fourth coaxial transmission line which is continuous with said first coaxial transmission line.

7. A load according to claim 6, further including a connector disposed as a longitudinal prolongation of said mounting block, said connector including a base which is fixed to said mounting block, and having a central conductor ribbon with a first end connnected to said body of said first assembly and with a second end adapted for connnection to a DC voltage source, said connector, once fixed to said mounting block, comprising an inlet terminal for said DC voltage source.

8. A load according to claim 7, wherein said base of said connector is fixed to said face of said block which is flush with said third assembly, and wherein said ribbon is in direct contact with said third rod.

9. A load according to claim 8, wherein said mounting block and said base of said connector are of identical cross section.

10. An isolator made from a circulator, said circulator comprising:

a central conductor having three branches oriented at substantially 120° with respect to one another;

two pieces of ferrimagnetic material between which said central conductor is inserted;

two ground planes between which said two pieces of ferrimagnetic material and said central conductor are disposed;

means for applying a magnetic bias field to said two pieces of ferrimagnetic material, wherein one of said three branches includes a coaxial microwave load comprising:

a first assembly including: (a) cylindrical conductive body having a diameter and a first end face which is closed by a conductive portion and a second end face which is open; (b) a first cylindrical rod lodged inside said body and having a length shorter than said body and made of an insulating material covered with a resistive layer and having a first metallized end fixed to said conductive portion and a second metallized end; (c) a first washer of insulating material interposed between said body and said first rod and having a length substantially equal to said body, said first washer and said first rod being inserted into said body through said second end face; and (d) an intermediate conductive member provided with a central hole and lodged inside said body between said second end face of said body and said second metallized end of said first rod to which said intermediate member is fixed, whereby said body and said first rod and said first washer comprise a first coaxial transmission line having a given characteristic impedance to which said resistive layer of said first rod is matched, and whereby said intermediate conductive member and said first washer comprise a second coaxial transmission line which is continuous with said first coaxial transmission line;

a mounting block made of a conductive material and having a central bore for receiving said first assembly, said mounting block having an inside surface and an outside surface both of which are covered with an insulating layer such that said load is DC isolated once said first assembly is lodged in said mounting block;

a second assembly including: (a) a second washer of insulating material and having a central bore and a diameter which is substantially less than said diameter of said body; and (b) a second rod of conductive material fixed in said second washer central bore and having one end which terminates in a longitudinally projecting point for making contact with said intermediate conductive member inside said intermediate conductive member central hole, said second washer abutting against said first washer, whereby said first and second assemblies comprise a single unitary assembly once said point has made contact inside said central hole; and a connector disposed as a longitudinal prolongation of said mounting block and having a base fixed to said mounting block and a central conductor ribbon with a first end connected to said body of said first assembly and a second end adapted for connection to a DC voltage source, said connector, once fixed to said mounting block, comprising an inlet terminal for said DC voltage source.

11. An isolator according to claim 10, wherein the other two branches of said central conductor are each fixed to a connector having a base fixed to said ground planes and a central conductive member with an end connected to said central conductor.

12. A microwave system comprising:

a microwave source;

an active device requiring a bias provided by a DC voltage source; and a decoupler circuit connected between said microwave source and said active device, such decoupler circuit including a coaxial microwave load comprising:

a first assembly including: (a) a cylindrical conductive body having a diameter and a first end face which is closed by a conductive portion and a second end face which is open; (b) a first cylindrical rod lodged inside said body and having a length shorter than said body and made of an insulating material covered with a resistive layer and having a first metallized end fixed to said conductive portion and a second metallized end; (c) a first washer of insulating material interposed between said body and said first rod and having a length substantially equal to said body, said first washer and said first rod being inserted into said body through said second end face; and (d) an intermediate conductive member provided with a central hole and lodged inside said body between said second end face of said body and said second metallized end of said first rod to which said intermediate member is fixed, whereby said body and said first rod and said first wahser comprise a first coaxial transmission line having a given characteristic impedance to which said resistive layer of said first rod is matched, and whereby said intermediate conductive member and said first washer comprise a second coaxial transmission line which is continuous with said first coaxial trnasmission line;

a mounting block made of a conductive material and having a central bore for receiving said first assembly, said mounting block having an inside surface and an outside surface both of which are covered with an insulating layer such that said load is DC isolated once said first assembly is lodged in said mounting block;

a second assembly including: (a) a second washer of insulating material and having a central bore and a diameter which is substantially less than said diameter of said body; and (b) a second rod of conductive material fixed in said second washer central bore and having one end which terminates in a longitudinally projecting point for making contact with said intermediate conductive member inside said intermediate conductive member central hole, said second washer abutting against said first washer, whereby said first and second assemblies comprise a single unitary assembly once said point has made contact inside said central hole; and a connector disposed as a longitudinal prolongation of said mounting block and having a base fixed to said mounting block and a central conductor ribbon with a first end connected to said body of said first assembly and a second end adapted for connection to a DC voltage source, said connector, once fixed to said mounting block, comprising an inlet terminal for said DC voltage source.

13. A method of isolating a microwave source from an active device requiring a DC bias, comprising the steps:

connecting a decoupling circuit between said microwave source and said active device, said decoupler circuit including a coaxial microwave load comprising:

a first assembly including: (a) a cylindrical conductive body having a diameter and a first end face which is closed by a conductive portion and a second end face which is open; (b) a first cylindrical rod lodged inside said body and having a length shorter than said body and made of an insulating material covered with a resistive layer and having a first metallized end fixed to said conductive portion and a second metallized end; (c) a first washer of insulating material interposed between said body and said first rod and having a length substantially equal to said body, said first washer and said first rod being inserted into said body through said second end face; (d) an intermediate conductive member provided with a central hole and lodged inside said body between said second end face of said body and said second metallized end of said first rod to which said intermediate member is fixed, whereby said body and said first rod and said first washer comprise a first coaxial transmission line having a given characteristic impedance to which said resistive layer of said first rod is matched, and whereby said intermediate conductive member and said first washer comprise a second coaxial trnasmission line which is continuous with said first coaxial transmission line;

a mounting block made of a conductive material and having a central bore for receiving said first assembly, said mounting block having an inside surface and an outside surface both of which are covered with an insulating layer such that said load is DC isolated once said first assembly is lodged in said mounting block;

a second assembly including: (a) a second washer of insulating material and having a central bore and a diameter which is substantially less than said diameter of said body; and (b) a second rod of conductive material fixed in said second washer central bore and having one end which terminates in a longitudinally projecting point for making contact with said intermediate conductive member inside said intermediate conductive member central hole, said second washer abutting against said first washer, whereby said first and second assemblies comprise a single unitary assembly once said point has made contact inside said central hole; and a connector disposed as a longitudinal prolongation of said mounting block and having a base fixed to said mounting block and a central conductor ribbon with a first end connected to said body of said first assembly and a second end adapted for connecting to a DC voltage source, said connector, once fixed to said mounting block, comprising an inlet terminal for said DC voltage source; and providing a DC bias voltage to said connector.

* * * * *